US005230588A

United States Patent [19]

Wittke et al.

[11] Patent Number: 5,230,588

[45] Date of Patent: Jul. 27, 1993

[54] METHOD AND DEVICE FOR PAYING OUT OR HAULING IN THE SUPPLY LINE CABLE OF AN UNDERWATER DEVICE

[75] Inventors: Hermann Wittke; Friedrich Temmelmann, both of Hamburg, Fed. Rep. of Germany

[73] Assignee: ABB Patent GmbH, Mannheim, Fed. Rep. of Germany

[21] Appl. No.: 835,701

[22] Filed: Feb. 12, 1992

[30] Foreign Application Priority Data

Feb. 12, 1991 [DE] Fed. Rep. of Germany ..... 4104120
Aug. 28, 1991 [DE] Fed. Rep. of Germany ..... 4128513

[51] Int. Cl.[5] ..... B63C 11/00

[52] U.S. Cl. ..... 405/191; 254/278; 254/DIG. 14; 405/185; 405/190; 242/58.1; 242/54 R

[58] Field of Search ..... 405/190, 191, 192, 188; 242/54 R, 58.1, 58.2; 254/278, DIG. 14

[56] References Cited

U.S. PATENT DOCUMENTS

| | | | |
|---|---|---|---|
| 2,314,733 | 3/1943 | Owen | 254/278 X |
| 2,649,261 | 8/1953 | Badiuk et al. . | |
| 2,792,930 | 5/1957 | Graham . | |
| 2,904,273 | 9/1959 | Turner et al. | 242/54 R |
| 3,014,984 | 12/1961 | Jacobson | 405/191 X |
| 3,093,333 | 6/1963 | Bishop | 242/54 R |
| 3,172,510 | 3/1965 | Lee et al. . | |
| 3,876,045 | 4/1975 | Knarreborg | 242/54 R X |
| 4,010,619 | 3/1977 | Hightower et al. | 405/191 |
| 4,217,066 | 8/1980 | Gunther . | |
| 4,387,863 | 6/1983 | Edmonston et al. . | |
| 4,451,013 | 5/1984 | Bedrosian . | |
| 4,649,954 | 3/1987 | Dunwoody | 242/54 R X |
| 5,131,593 | 7/1992 | Siegfried et al. | 242/58.1 |

FOREIGN PATENT DOCUMENTS

| | | |
|---|---|---|
| 0145688 | 6/1985 | European Pat. Off. . |
| 1041126 | 10/1958 | Fed. Rep. of Germany . |
| 1138135 | 10/1962 | Fed. Rep. of Germany . |
| 2030162 | 8/1973 | Fed. Rep. of Germany . |
| 2304741 | 8/1976 | Fed. Rep. of Germany . |
| 2745518 | 11/1978 | Fed. Rep. of Germany . |
| 2916942 | 11/1979 | Fed. Rep. of Germany . |
| 2920179 | 11/1979 | Fed. Rep. of Germany . |
| 2524856 | 10/1983 | France . |
| 8206095 | 10/1983 | France . |
| 52-133699 | 4/1976 | Japan . |
| 734082 | 7/1955 | United Kingdom . |
| 2046207 | 11/1980 | United Kingdom . |
| 2053823 | 2/1981 | United Kingdom . |

OTHER PUBLICATIONS

"Hansa-Schiffahrt-Schiffbau-Hafen", May 1980, No. 9, pp. 659-661, p. 660.

*Primary Examiner*—Dennis L. Taylor
*Attorney, Agent, or Firm*—Herbert L. Lerner; Laurence A. Greenberg

[57] ABSTRACT

In a method and a device for paying out or hauling in a supply line cable of an underwater device from a ship or a suitable platform, the supply line cable is guided from a drum of a winch through a lower guide roller and over the edge of the ship. A pivoting device is rotated from a vertical position into a horizontal position about the axis of the lower guide roller, or about an axis parallel thereto, for lockingly coupling or uncoupling the cable coupling of the supply line cable to a cable coupling of another supply line cable. As a result of the rotation of the pivoting device, it serves as a horizontal working platform for the coupling or uncoupling process. The pivoting device is returned to its vertical position after the coupling or uncoupling has been completed. The pivoting device is dimensioned in such a manner that the cable couplings of the two supply line cables can be aligned with one another at a spatial distance governed by necessary cable connecting lines.

40 Claims, 2 Drawing Sheets

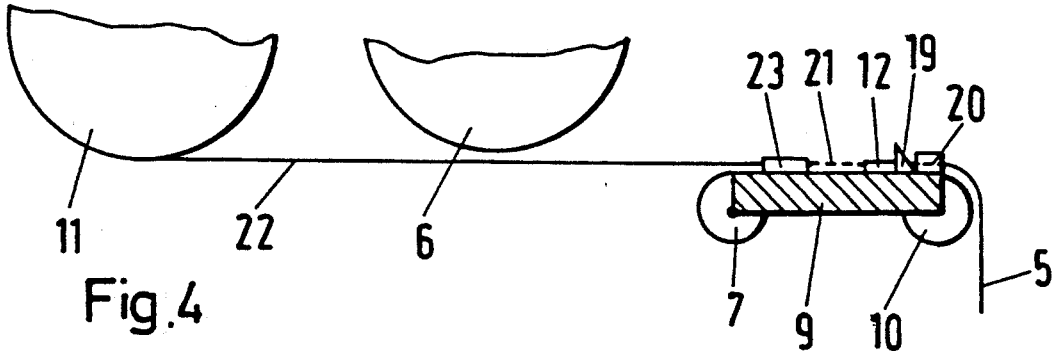
Fig.4
Fig.5
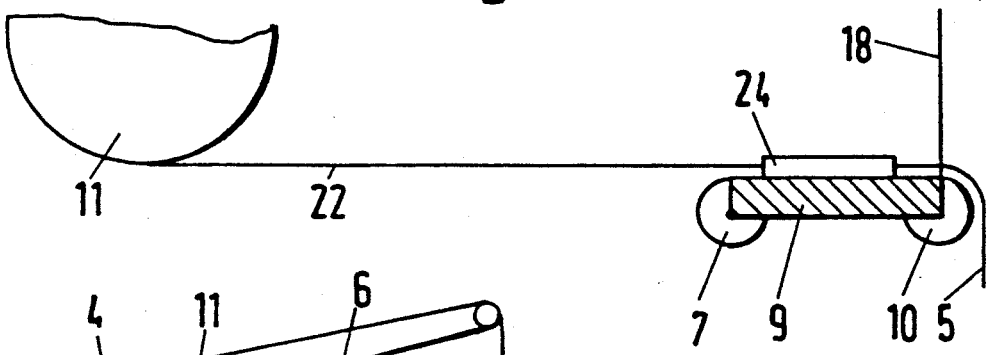
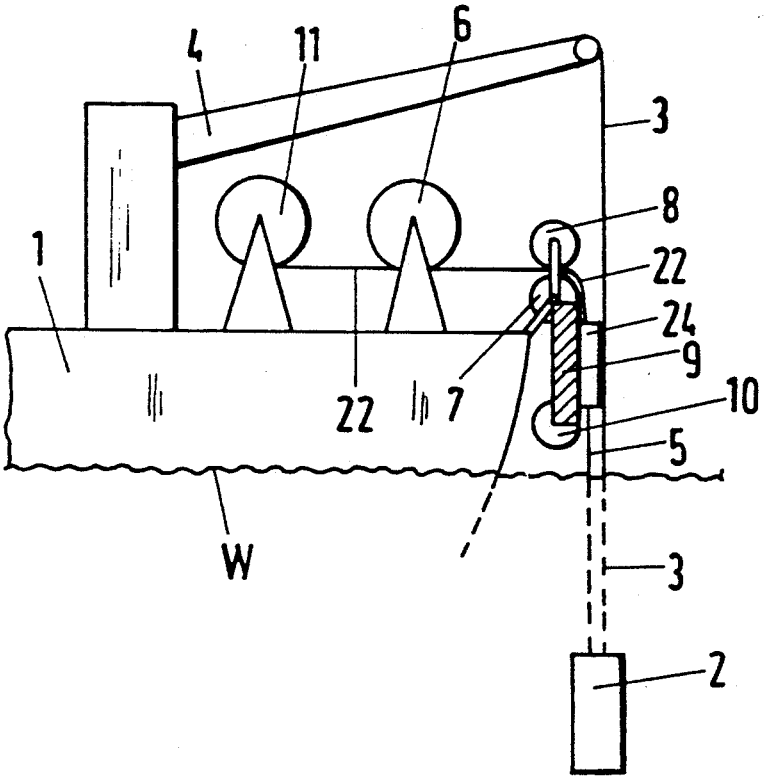
Fig.6

METHOD AND DEVICE FOR PAYING OUT OR HAULING IN THE SUPPLY LINE CABLE OF AN UNDERWATER DEVICE

The invention relates to a method and a device for paying out or hauling in a supply line cable of an underwater device from a ship or a suitable platform, wherein the supply line cable is guided from a drum of a winch past a lower guide roller and over an edge of the ship.

In order to carry out research of the seabed or to provide underwater pile foundations, it is generally normal to lower suitably equipped underwater devices from a ship or a suitable platform onto the seabed. In such a case, the underwater device is lowered on a holding cable rope by using a crane, while the supply line cable, which is used for the power supply of the underwater device and for signal transmission, is unwound from the drum of a winch and is guided over the edge of the vessel past a lower guide roller. In that case, the capacity of the drum is restricted to a maximum cable length of approximately 1250 m. In other words, it is not possible to lower an underwater device deeper than approximately 1250 m with a single-piece supply line cable. If, for example, it is intended to lower the underwater device to a sea depth of approximately 2000 m, it is necessary to couple two supply line cables in a force-locking manner and to make electrical and hydraulic connections. In such a case, there are difficulties in guiding the stiff coupling device over the lower guide roller without damaging the cable. A force-locking connection is one which connects two elements together by force external to the elements, as opposed to a form-locking connection which is provided by the shapes of the elements themselves.

It is accordingly an object of the invention to provide a method and a device for paying out or hauling in the supply line cable of an underwater device, which overcome the hereinafore-mentioned disadvantages of the heretofore-known methods and devices of this general type and which permit the force-locking coupling of at least two supply line cables in a simple manner.

With the foregoing and other objects in view there is provided, in accordance with the invention, a method for paying out and hauling in a supply line cable of an underwater device from a support, such as a ship or a platform, disposed in the vicinity of the surface of a body of water, which comprises attaching a first supply line cable between an underwater device and a first cable coupling, attaching a second cable coupling to a second supply line cable, guiding the first supply line cable from a drum of a winch disposed on the support, past a lower guide roller and over an edge of the support, rotating a pivoting device from a vertical position to a horizontal position in the vicinity of the first supply line cable about the axis of the lower guide roller or about an axis parallel to the axis of the lower guide roller, force-lockingly coupling or uncoupling the first and second cable couplings with the pivoting device serving as a horizontal working platform for coupling or uncoupling, and returning the pivoting device to the vertical position after the coupling or uncoupling.

In accordance with another mode feature of the invention, there is provided a method which comprises rotating the pivoting device through at least 90° with a crane.

In accordance with a further mode of the invention, there is provided a method which comprises guiding the unwound first supply line cable during the rotation of the pivoting device with a further guide roller being mounted on a lower end of the pivoting device when the pivoting device is in the vertical position.

In accordance with an added mode of the invention, there is provided a method which comprises guiding the unwound first supply line cable during the rotation of the pivoting device with an upper guide roller being mounted on an upper end of the pivoting device when the pivoting device is in the vertical position.

In accordance with an additional mode of the invention, there is provided a method which comprises connecting the first cable coupling to a cable rope of an auxiliary winch, and bringing the first cable coupling into a coupling or uncoupling position on the horizontal pivoting device or in a drum pocket of the winch from which the first supply line cable is guided, with the auxiliary winch.

In accordance with yet another mode of the invention, there is provided a method which comprises driving the auxiliary winch vertically along a frame for ensuring straight-line transmission of tensile force from the cable rope of the auxiliary winch through the first cable coupling to the first supply line cable.

In accordance with yet a further mode of the invention, there is provided a method which comprises connecting the first cable coupling and the cable rope to a cage.

In accordance with yet an added mode of the invention, there is provided a method which comprises attaching a locking support to the pivoting device for fixing the first cable coupling of the unwound first supply line cable.

In accordance with yet an additional mode of the invention, there is provided a method which comprises pulling the second supply line cable to be coupled to the first supply line cable into a predetermined position on the horizontal pivoting device with a hand winch mounted on the pivoting device.

In accordance with again another mode of the invention, there is provided a method which comprises pulling the second supply line cable to be coupled to the first supply line cable into a predetermined position on the horizontal pivoting device with a further guide roller mounted on the pivoting device and with an auxiliary winch.

In accordance with again a further mode of the invention, there is provided a method which comprises force-locking the first and second cable couplings lying on the horizontal pivoting device to one another with two half shells serving as a tension device.

With the objects of the invention in view, there is also provided a device for paying out or hauling in a supply line cable of an underwater device from a support, such as a ship or a platform, disposed in the vicinity of the surface of a body of water, comprising a winch being disposed on a support and having a drum, a first supply line cable to be connected to an underwater device and guided from the drum over an edge of the support, a lower guide roller about which the first supply line cable is guided, the lower guide roller having an axis, a first cable coupling connected to the first supply line cable, a second supply line cable having a second cable coupling to be connected to the first cable coupling, and a pivoting device to be rotated about the axis of the lower guide roller or about an axis parallel thereto between a vertical position and a horizontal position in the vicinity of the cable couplings for mutually aligning the cable couplings at a spatial distance required cable connecting lines.

In accordance with another feature of the invention, the pivoting device has a lower end as seen in the vertical position, and there is provided a guide roller disposed on the lower end.

In accordance with a further feature of the invention, the pivoting device has an upper end as seen in the vertical position, and there is provided an upper guide roller, and means disposed on the upper end for retaining the upper guide roller above the lower guide roller during paying out and hauling in of the first supply line cable.

In accordance with an added feature of the invention, there is provided another winch having a drum for the second supply line cable, the winches being mutually aligned.

In accordance with an additional feature of the invention, the drum of the winch has a drum pocket for retention and attachment of the first cable coupling.

In accordance with yet another feature of the invention, there is provided a cable rope, and a cage to be connected to the first cable coupling, the cage having means for attaching the cable rope.

In accordance with yet a further feature of the invention, there is provided an auxiliary winch disposed behind the drum of the winch from which the first supply line cable is guided, as seen from the pivoting device, the auxiliary winch being connected by the cable rope to the first cable coupling or to the cage.

In accordance with yet an added feature of the invention, there are provided means for driving the auxiliary winch vertically.

In accordance with yet an additional feature of the invention, the pivoting device has means for attaching a locking support.

In accordance with again another feature of the invention, the pivoting device has a hand winch.

In accordance with again a further feature of the invention, the pivoting device has a further guide roller.

In accordance with again an added feature of the invention, the further guide roller is detachable.

In accordance with a concomitant feature of the invention, the pivoting device is detachable.

The advantages which can be achieved with the invention are especially seen in that when the pivoting device is rotated into the horizontal position, a working platform is provided on which the tasks necessary for coupling the two supply line cables can be carried out in a simple manner at sea. The high tensional force generated by the weight of the already unwound supply line cable is "absorbed" by the pivoting device. Since the coupling process takes place downstream of the lower guide roller, as seen from the edge of the vessel, it is not necessary to guide the coupling over any form of guide roller, but instead the pivoting device is rotated in a simple manner into its vertical position, after which the coupling can be lowered in the direction of the water level without further obstructions.

Other features which are considered as characteristic for the invention are set forth in the appended claims.

Although the invention is illustrated and described herein as embodied in a method and a device for paying out or hauling in the supply line cable of an underwater device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 4 is another similar view of two cable couplings of supply line cables which have been positioned for coupling;

FIG. 5 is a further similar view of two supply line cables which have been coupled together; and FIG. 6 is a view similar to FIG. 1 showing a pivoting device which has been brought into the vertical position.

Figure 1:
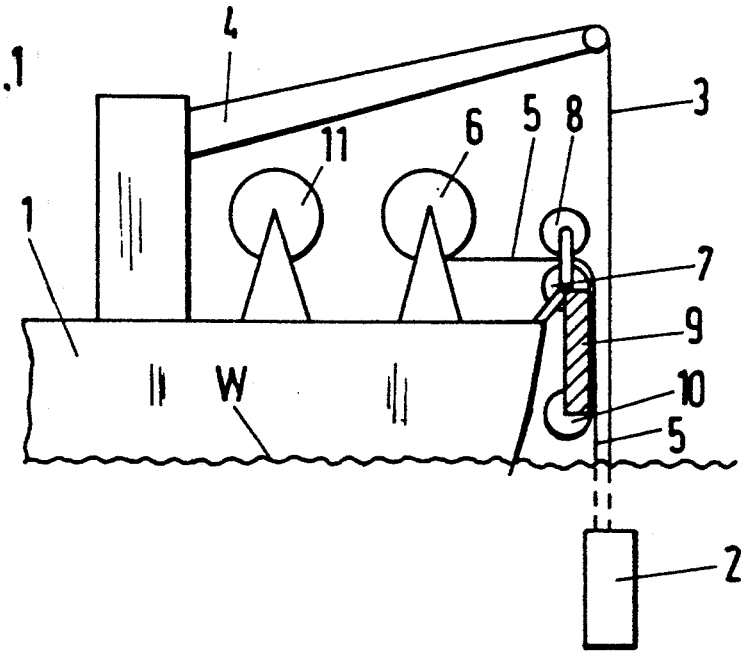
FIG. 1 is a fragmentary, diagrammatic, side-elevational view of the stern of a ship with a device for paying out and hauling in supply line cables for underwater devices.

Referring now to the figures of the drawing in detail and first, particularly, to FIG. 1 thereof, there is seen a stern of a ship with a device for paying out or lowering and hauling in supply lines for underwater devices. The device for paying out and hauling in supply lines may be disposed on any support disposed in the vicinity of the surface of a body of water. In this case, a ship is used as the support, but a platform or any other such support may be used as well. A ship 1 can be seen having a stern from which it is intended to lower an underwater device 2 to the seabed or to haul the device up from the seabed. The underwater device 2 can, for example, be a station for research of the seabed, an underwater hammering station for pile foundations or the like. During paying out or hauling in, the weight of the underwater device 2 loads a crane 4 through a supporting cable rope 3. The crane 4 is mounted on the ship 1 or on a separate platform. A supply line cable or umbilical 5 is provided between the underwater device 2 and the ship 1 in order to supply the underwater device 2 with electrical voltage, for operating hydraulic devices etc. and for driving and reporting back by means of electrical signals.

During paying out, this supply line cable 5 is unwound from a drum of a first winch 6 and is wound in reverse onto the drum of the winch 6 during hauling in. A lower guide roller 7, projecting over the edge of the vessel, is provided for low-friction guidance of the supply line cable 5. In other words, the supply line cable 5 is guided from the first winch 6 and over the lower guide roller 7, which deflects it through 90° in the direction of a water level W and of the seabed. An additional upper guide roller 8 improves the guidance characteristics while the underwater device is raised above the water level W by the crane 4.

On the axis of the lower guide roller 7, or parallel thereto, there is mounted a pivoting device 9 which can rotate through at least 90° about this axis or about an axis parallel thereto. During paying out or hauling in of the supply line cable, this pivoting device 9 is located in the vertical position so that the supply line cable 5 can move in the direction of the water level W, without touching the pivoting device 9. A further guide roller 10 is located on the end of the pivoting device 9 which faces the water level W in the vertical position.

In addition, a second winch 11 which is in series with the first winch 6, can be seen in FIG. 1. The function of the second winch 11 is explained, in particular, in the description of FIGS. 4 and 5. In general, the object is to lower an underwater device 2 to a seabed depth of 2000 m, for example. Since the drum of the winch 6 has a supply line cable 5 with a maximum length of 1250 m, in order to reach the seabed it is necessary to couple this supply line cable 5 to an additional supply line cable 22, which is seen in FIGS. 4 and 5. This additional supply line cable 22 is located on the drum of the second winch 11.

Figure 2:
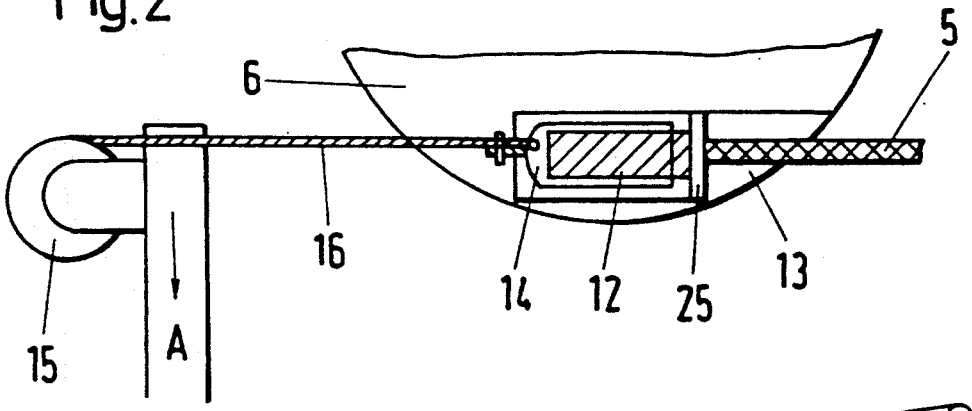
FIG. 2 is an enlarged, fragmentary, side-elevational view of a winch with a drum pocket.

Before coupling the two supply line cables 5 and 22, there is a problem of removing the supply line cable 5, which is under great tension as a result of its inherent weight, from the winch 6. As is seen in FIG. 2, the drum of the winch 6 is specially constructed for this purpose and has a drum pocket 13 on the side, which holds a cable coupling 12 of the supply line cable 5. The cable coupling 12 is attached to a flange 25 of the drum pocket 13, such as through the use of a screw attachment, for example.

In FIG. 2, which shows the first winch 6 with the drum pocket 13, it can also be seen that a cage 14 that is connected to the cable coupling 12, is provided with an eye for fixing a drum cable rope 16 to an auxiliary winch 15. As seen from the stern of the ship, the auxiliary winch 15 is located behind the winch 6 and can be driven vertically along a frame, in order to ensure that straight-line transmission of the tensile force always takes place from the supply line cable 5, through the cable coupling 12, the cage 14 and the drum cable rope 16, to the auxiliary winch 15.

In one operation, the drum pocket 13 is opened as seen in FIG. 2 by removal of a pocket cover and the cage 14 is screwed to the cable coupling 12 of the supply line cable 5, which is unwound to its limit position. In a further operation, the drum cable rope 16 is attached to the cage 14, such as by shackles, and is tightened with the auxiliary winch 15. The attachment between the cable coupling 12 and the flange 25 of the drum pocket 13 can then be released. Subsequently, the auxiliary winch 15 is driven vertically downwards along the frame, in accordance with an arrow direction A, such as by means of a hydraulic drive.

Figure 3:
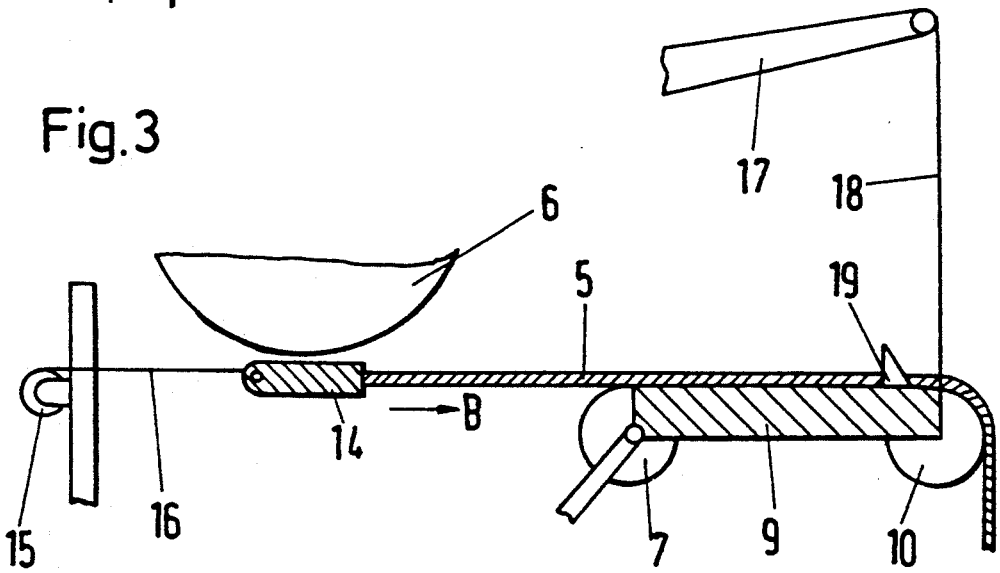
FIG. 3 is a view similar to FIG. 2 of a pivoting device which has been brought into a horizontal position.

The winch 6 is then in the position shown in FIG. 3, in which an essentially horizontal transmission of the tensile force is ensured from the auxiliary winch 15, through the drum cable rope 16, the cage 14 with the cable coupling 12 mounted thereon, to the supply line cable 5. The cage 14 with the mounted cable coupling 12 can easily be removed from the drum pocket 13 after the winch has been moved- in an arrow direction A.

Furthermore, the pivoting device 9 is brought from its vertical position into its horizontal position, as is shown in FIG. 3. For this purpose, the end of the pivoting device 9 facing the water level W is pivoted upward into a horizontal position by means of a cable rope 18 that is connected to a crane 17. During the pivoting process, the axis of the lower guide roller 7, or an axis parallel thereto, acts as an axis of rotation and the supply line cable 5 engages in the guide roller 10 of the pivoting device 9.

A removable locking support 19 is attached onto the pivoting device 9, in an operation which is carried out next. As a result of monitoring the paying out of the cable rope 16 using the auxiliary winch 15, the supply line cable 5 is lowered over the guide roller 10 until the cable coupling 12 reaches the locking support 19 and is held fixed by the latter. Subsequently, the cage 14 can be detached from the cable coupling 12 and the drum cable rope 16 which is detached from the cage 14, is wound onto the auxiliary winch 15.

As is shown in FIG. 4, the additional supply line cable 22 is subsequently unwound from the drum of the second winch 11 until a cable coupling 23 of this cable 22 is located on the pivoting device 9 and is at a predetermined distance from the cable coupling 12 of the cable 5, which is fixed by means of the locking support 19. This distance which can be predetermined is governed essentially by the length of cable connecting lines to be provided between the two cable couplings 12, 23. In order to simplify unwinding of the cable 22 from the drum of the second winch 11, a hand winch 20 having a cable rope 21 connected to the cable coupling 23, is disposed behind the locking support 19 on the pivoting device 9. Subsequently, the supply line cable 22 can be pulled through under the drum of the first winch 6 in the direction of an arrow B. As an alternative to this, an auxiliary guide roller can be mounted instead of the hand winch 20. In this variation, the supply line cable 22 is pulled towards the pivoting device 9 through the drum cable rope 16, by means of the auxiliary winch 15, with the drum cable rope 16 being guided over the auxiliary guide roller.

In a further operation, there is a following connection of the two supply line cables 5, 22 through cable connecting lines of suitable construction. The pivoting device 9 acts as a working platform for this purpose. The individual connections must be implemented in a waterproof manner and it is necessary to suitably to take into account the water pressure at a sea depth of 2000 m, for example. After making the connections, two half shells of stainless steel in the form of a tension device 24, are placed around the two cable couplings 12, 23 and the mounted cable connecting lines and are screwed tightly to cages of the cable couplings 12, 23, as is shown in FIG. 5. This tension device 24 transmits the tensile force generated by the inherent weight of the supply line cable 5 to the supply line cable 22 and to the second winch 11. The tension device 24 itself must enclose the cable couplings 12, 23 and the cable connecting lines in a non-waterproof manner.

After the second winch 11 has taken over the tensile force by heaving in, the locking support 19 can be removed and the pivoting device 9 can be rotated through 90° again, from the horizontal position into the vertical position. This is done by letting out the cable rope 18 which is attached to the crane 17. During the pivoting process, the cable 22 engages in the lower guide roller 7, while the guide roller 10 guides the cable 5 and the pivoting device 9 is released in the vertical position. After completion of the pivoting process, the pivoting device is located in the vertical position, as is shown in FIG. 6.

Thereafter, the cable 22 can be unwound from the drum of the second winch 11 until the underwater device 2 has reached the desired operating depth.

If it is intended to lower the underwater device 2 to a greater sea depth than approximately 2500 m, further additional winches with further additional supply line cables can be provided. In each case, the coupling process between two supply line cables takes place in the manner described above.

In general, the above-described embodiments can be supplemented by the upper guide roller 8 which in each case is lifted off or detached as soon as a cable coupling of a supply line cable runs over the lower guide roller 7. As an alternative to this it is also possible to remove the upper guide roller 8 from its normal position above the guide roller 7 in order to perform the coupling process and to mount it at the position of the guide roller 10. In this variation, a dedicated guide roller 10 is advantageously omitted. The mounting of the guide roller 8 to the pivoting device 9 and its removal therefrom in each case must take place in the vertical position of the pivoting device. The complete pivoting device 9 can also be detached.

The hauling in of the supply line cable and the decoupling of the cable couplings takes place in a sequence which is the reverse of the above-described activities, that relate essentially to paying out. In particular, the pivoting device 9 is not rotated from its vertical position into its horizontal position until the tension device 24 is located immediately adjacent the pivoting device as seen in FIG. 6, so that the configuration shown in FIG. 5, with the tension device 24 located on the working platform, is produced after the pivoting has been completed. Precise positioning of the tension device 24 in the desired position can take place by means of the second winch 11. The locking support 19 is mounted subsequently, for fixing the cable coupling 12. The tension device 24 can then be detached and removed. After detachment of the cable connecting lines, the supply line cable 22 including the cable coupling 23, can be wound completely onto the drum of the winch 11.

Subsequently, the cage 14 can be connected to the cable coupling 12, whereupon the cable coupling 12 is guided into the cable pocket 13 of the winch 6, by using the auxiliary winch 15. After detachment of the locking support 19, the pivoting device 9 can be rotated into the vertical position again, or can be detached. There follows a vertical movement of the auxiliary winch 15, against the direction of the arrow A. After the cable coupling 12 has been attached to the flange 25 of the drum pocket 13, the cage 14 can be detached from the drum cable rope 16, the pocket cover can be mounted on the drum pocket 13 and the supply line cable 5 can be hauled in by using the winch 6.

We claim:

1. A method for paying out and hauling in a supply line cable of an underwater device from a support disposed in the vicinity of the surface of a body of water, which comprises attaching a first supply line cable between an underwater device and a first cable coupling, attaching a second cable coupling to a second supply line cable, guiding the first supply line cable from a drum of a winch disposed on the support and over an edge of the support, rotating a pivoting device having means for arresting the first cable coupling and means for drawing the second cable coupling towards the arresting means from a vertical position to a horizontal position in the vicinity of the first supply line cable, arresting the first cable coupling with the arresting means of the pivoting device, coupling or uncoupling the first and second cable couplings with the pivoting device serving as a horizontal working platform for coupling or uncoupling, and returning the pivoting device to the vertical position after the coupling or uncoupling.

2. The method according to claim 1, which comprises guiding the first supply line cable past a lower guide roller, and rotating the pivoting device about the axis of the lower guide roller.

3. The method according to claim 1, which comprises guiding the first supply line cable past a lower guide roller, and rotating the pivoting device about an axis parallel to the axis of the lower guide roller.

4. The method according to claim 1, which comprises guiding the supply line cable from a ship having the support.

5. The method according to claim 1, which comprises guiding the supply line cable from a platform having the support.

6. The method according to claim 1, which comprises rotating the pivoting device through at least 90° with a crane.

7. The method according to claim 2, which comprises guiding the unwound first supply line cable during the rotation of the pivoting device with a further guide roller being mounted on a lower end of the pivoting device when the pivoting device is in the vertical position.

8. The method according to claim 3, which comprises guiding the unwound first supply line cable during the rotation of the pivoting device with a further guide roller being mounted on a lower end of the pivoting device when the pivoting device is in the vertical position.

9. The method according to claim 2, which comprises guiding the unwound first supply line cable during the rotation of the pivoting device with an upper guide roller being mounted on an upper end of the pivoting device when the pivoting device is in the vertical position.

10. The method according to claim 3, which comprises guiding the unwound first supply line cable during the rotation of the pivoting device with an upper guide roller being mounted on an upper end of the pivoting device when the pivoting device is in the vertical position.

11. The method according to according to claim 1, which comprises connecting the first cable coupling to a cable rope of an auxiliary winch, and bringing the first cable coupling into a coupling or uncoupling position on the horizontal pivoting device with the auxiliary winch.

12. The method according to claim 1, which comprises connecting the first cable coupling to a cable rope of an auxiliary winch, and bringing the first cable coupling into a coupling or uncoupling position in a drum pocket of the winch from which the first supply line cable is guided, with the auxiliary winch.

13. The method according to claim 11, which comprises driving the auxiliary winch vertically along a frame for ensuring straight-line transmission of tensile force from the cable rope of the auxiliary winch through the first cable coupling to the first supply line cable.

14. The method according to claim 12, which comprises driving the auxiliary winch vertically along a frame for ensuring straight-line transmission of tensile force from the cable rope of the auxiliary winch through the first cable coupling to the first supply line cable.

15. The method according to claim 11, which comprises connecting the first cable coupling and the cable rope to a cage.

16. The method according to claim 12, which comprises connecting the first cable coupling and the cable rope to a cage.

17. The method according to according to claim 1, which comprises attaching a locking support to the pivoting device for fixing the first cable coupling to the unwound first supply line cable.

18. The method according to according to claim 1, which comprises pulling the second supply line cable to be coupled to the first supply line cable into a predetermined position on the horizontal pivoting device with a hand winch mounted on the pivoting device.

19. The method according to according to claim 1, which comprises pulling the second supply line cable to be coupled to the first supply line cable into a predetermined position on the horizontal pivoting device with a further guide roller mounted on the pivoting device and with an auxiliary winch.

20. The method according to according to claim 1, which comprises locking the first and second cable couplings lying on the horizontal pivoting device to one another with two half shells serving as a tension device.

21. A device for paying out of hauling in a supply line cable of an underwater device from a support disposed in the vicinity of the surface of a body of water, comprising a winch being disposed on the support and having a drum, a first supply line cable releasably attached to said drum of said winch, said first supply line cable to be connected to an underwater device and guided from said drum over an edge of the support, a first cable coupling connected to an end of said first supply line cable, a second supply line cable having a second cable coupling disposed at an end thereof to be connected to said first cable coupling, and a pivoting device attached to an edge of the support, said pivoting device being rotatable between a vertical position and a horizontal position, said pivoting device being dimensioned large enough so as to allow said first and second cable couplings to be disposed thereon next to one another while keeping a spatial distance therebetween required for cable connecting lines.

22. The device according to claim 21, including a guide roller about which said first supply line cable is guided, said guide roller having an axis about which said pivoting device is rotated.

23. The device according to claim 21, including a guide roller about which said first supply line cable is guided, said guide roller having an axis, and said pivoting device being rotated about an axis parallel to the axis of said guide roller.

24. The device according to claim 21, wherein the support is part of a ship.

25. The device according to claim 21, wherein the support is part of a platform.

26. The device according to claim 21, wherein said pivoting device has a lower end as seen in the vertical position, and including a guide roller disposed on said lower end.

27. The device according to claim 22, wherein said guide roller is a lower guide roller and said pivoting device has an upper end as seen in the vertical position, and including an upper guide roller, and means disposed on said upper end for retaining said upper guide roller above said lower guide roller during paying out and hauling in of said first supply line cable.

28. The device according to claim 23, wherein said guide roller is a lower guide roller and said pivoting device has an upper end as seen in the vertical position, and including an upper guide roller, and means disposed on said upper end for retaining said upper guide roller above said lower guide roller during paying out and hauling in of said first supply line cable.

29. The device according to claim 21, including another winch having a drum for said second supply line cable, said winches being mutually aligned.

30. The device according to claim 21, wherein said drum of said winch has a drum pocket for retention and attachment of said first cable coupling.

31. The device according to claim 30, including a cable rope, and a cage to be connected to said first cable coupling, said cage having means for attaching said cable rope.

32. The device according to claim 31, including an auxiliary winch disposed behind said drum of said winch from which said first supply line cable is guided, as seen from said pivoting device, said auxiliary winch being connected by said cable rope to said first cable coupling.

33. The device according to claim 31, including an auxiliary winch disposed behind said drum of said winch from which said first supply line cable is guided, as seen from said pivoting device, said auxiliary winch being connected by said cable rope to said cage.

34. The device according to claim 32, including means for driving said auxiliary winch vertically.

35. The device according to claim 23, including means for driving said auxiliary winch vertically.

36. The device according to claim 21, wherein said pivoting device has means for attaching a locking support.

37. The device according to claim 21, wherein said pivoting device has a hand winch.

38. The device according to claim 21, wherein said pivoting device has a further guide roller.

39. The device according to claim 38, wherein said further guide roller is detachable.

40. The device according to claim 38, wherein said pivoting device is detachable.

* * * * *